US007373908B2

(12) United States Patent
Rizoulis et al.

(10) Patent No.: US 7,373,908 B2
(45) Date of Patent: May 20, 2008

(54) REDUCED NOISE ENGINE START-STOP SYSTEM USING TRADITIONAL CRANK DEVICE

(75) Inventors: Dimitrios Rizoulis, Ann Arbor, MI (US); Craig D. Marriott, Clawson, MI (US); Kenneth J. Buslepp, Brighton, MI (US); Douglas R. Verner, Sterling Heights, MI (US); William C. Albertson, Clinton Township, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/467,989

(22) Filed: Aug. 29, 2006

(65) Prior Publication Data

US 2008/0053390 A1 Mar. 6, 2008

(51) Int. Cl.
*F02N 11/00* (2006.01)

(52) U.S. Cl. ..... 123/179.25; 290/28 R

(58) Field of Classification Search ..... 123/179.25; 290/38 R, 28 A, 38 C
See application file for complete search history.

(56) References Cited

U.S. PATENT DOCUMENTS

| | | | | |
|---|---|---|---|---|
| 4,779,470 | A * | 10/1988 | Morita et al. | 74/7 R |
| 5,127,279 | A * | 7/1992 | Barthruff | 74/6 |
| 5,733,218 | A * | 3/1998 | Sudau et al. | 475/347 |
| 5,970,937 | A * | 10/1999 | Casellato et al. | 123/179.3 |
| 6,516,767 | B1 * | 2/2003 | Maillet et al. | 123/179.3 |
| 6,634,332 | B2 * | 10/2003 | Saito et al. | 123/179.3 |
| 2002/0135186 | A1 * | 9/2002 | Chane-Waye | 290/38 R |

* cited by examiner

*Primary Examiner*—Stephen K. Cronin
*Assistant Examiner*—Arnold Castro

(57) ABSTRACT

An engine starting system that regulates a position of a pinion gear of a starter motor between an engaged position and a disengaged position includes a solenoid pinion armature (SPA) that is coupled to the pinion gear and that is movable between a first position and a second position to move the pinion gear between the disengaged position and the engaged position. A damper dampens a velocity of the SPA during movement of the SPA to the second position to inhibit noise generation.

27 Claims, 6 Drawing Sheets

REDUCED NOISE ENGINE START-STOP SYSTEM USING TRADITIONAL CRANK DEVICE

FIELD OF THE INVENTION

The present invention relates to engine start-stop systems, and more particularly to a reduced noise engine start-stop system that implements traditional crank devices.

BACKGROUND OF THE INVENTION

Internal combustion engines combust a fuel and air mixture within cylinders driving pistons to produce drive torque. Engine start-up is induced based on an operator input. For example, an engine starting system cranks the engine and initiates the combustion process based on the operator turning an ignition switch to a start position or depressing a start button. Traditional engine starting systems include a starter motor that selectively drives a crankshaft. More specifically, a pinion gear of the starter motor is movable between an engaged position and a disengaged position relative to a flywheel ring gear.

Temporary engine shut-off at vehicle stop is implemented to reduce fuel consumption. Many configurations have been proposed to accomplish a prompt and low noise restart of the engine at the first indication of an acceleration request from the operator. An acceleration request can be indicated by the driver releasing pressure on a brake pedal and/or depressing an accelerator pedal. Most arrangements use complicated and expensive electric devices to accomplish the start-stop task while meeting noise, vibration and harshness (NVH) and response requirements.

Start-stop configurations using traditional starter motors and drive gear actuation are too noisy for a seamless and pleasing engine start. For example, noise from these systems emanates from a starter pinion solenoid, which moves the pinion gear between the engaged and disengaged positions. More specifically, an abrupt change in armature velocity occurs as the starter pinion solenoid makes contact with its stop.

SUMMARY OF THE INVENTION

Accordingly, the present invention provides an engine starting system that regulates a position of a pinion gear of a starter motor between an engaged position and a disengaged position. The engine starting system includes a solenoid pinion armature (SPA) that is coupled to the pinion gear and that is movable between a first position and a second position to move the pinion gear between the disengaged position and the engaged position. A damper dampens a velocity of the SPA during movement of the SPA to the second position to inhibit noise generation.

In one feature, the velocity of the SPA is un-damped for a first portion of travel to the second position and is damped for a second portion of travel to the second position.

In another feature, the damper includes a biasing member that imparts a biasing force on said SPA to dampen the velocity of the SPA.

In still other features, the damper includes a fluid that imparts a damping force on the SPA to dampen the velocity of the SPA. The damper includes a variable sized orifice that varies the damping force based on a position of the SPA. Alternatively, the damper includes a first orifice that enables exhaust of the fluid from the damper at a first rate and a second orifice that enables exhaust of the fluid at a second rate. The first orifice is open for a first portion of travel of the SPA to the second position and is closed for a second portion of travel of the SPA to the second position. As another alternative, the damper includes a one-way restrictor valve that provides the damping force during movement of the SPA to the second position and that enables un-damped movement of the SPA to the first position.

In still another feature, the damper is offset a distance from the SPA to engage the SPA for a portion of travel from the first position to the second position.

In yet another feature, the damper is coupled to the SPA.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
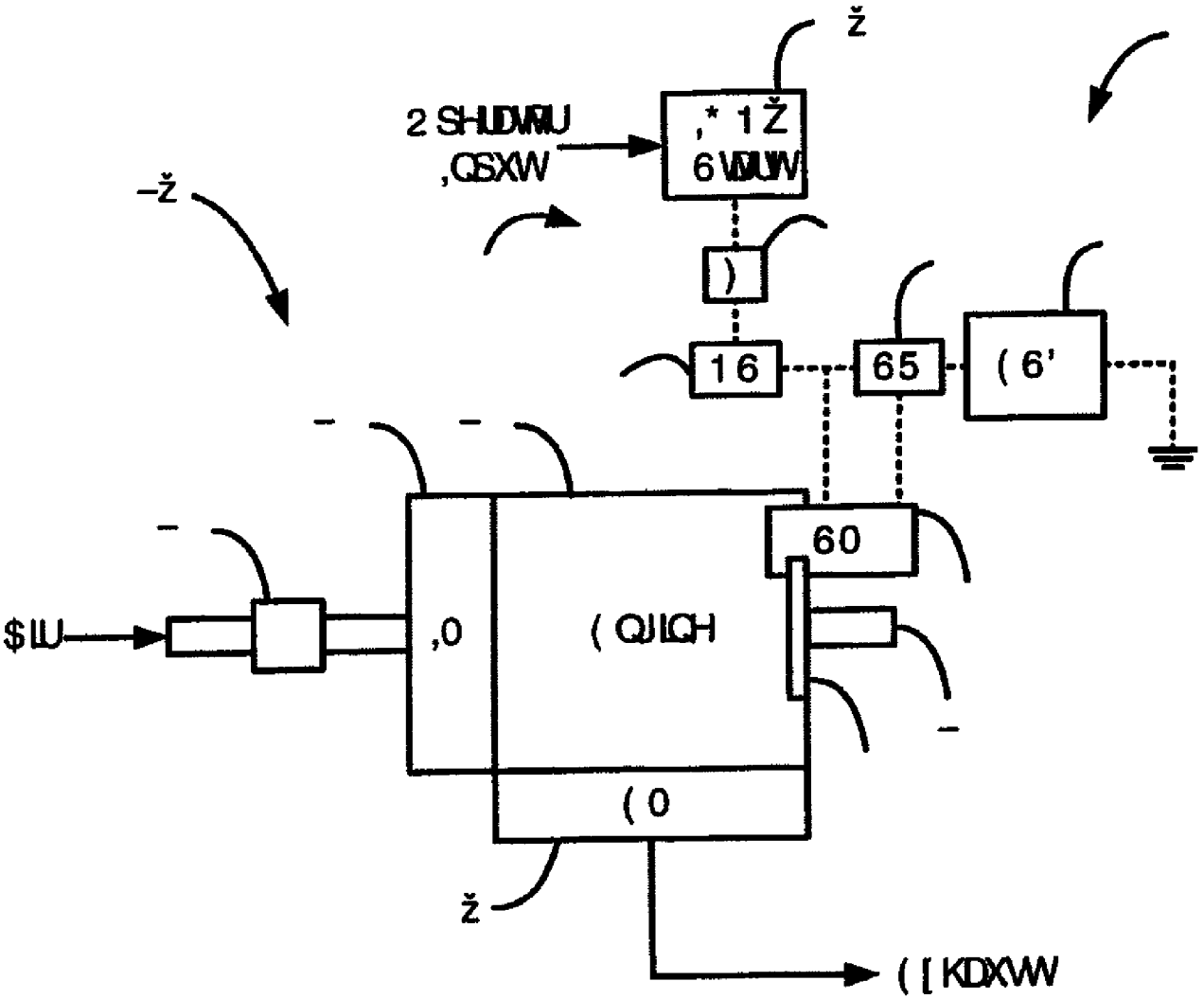
FIG. 1 is a functional block diagram of an exemplary engine system including an engine starting system according to the present invention.

The following description of the preferred embodiment is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality.

Referring now to FIG. 1, an exemplary vehicle system 10 is schematically illustrated. The vehicle system includes an engine 12 that combusts a fuel and air mixture within cylinders (not shown) to drive pistons slidably disposed within the cylinders. The pistons drive a crankshaft 14 to produce drive torque. Air is drawn through a throttle 16 and into an intake manifold 18 that distributes air to the individual cylinders. Exhaust generated by the combustion process is exhausted to an after-treatment system (not shown) through an exhaust manifold 20.

The vehicle system 10 further includes an engine starting system 22. The engine starting system 22 includes a flywheel ring gear 24, a starter motor 26 and a power system 28. The flywheel ring gear 24 is fixed for rotation with the crankshaft 14. The starter motor 26 selectively engages the flywheel ring gear 24, as explained in further detail below, to rotatably drive the crankshaft 14. In this manner, the engine 12 is cranked during a start-up routine.

The power system 28 includes an ignition switch or start button 30, an energy storage device (ESD) 32 (e.g., battery or super-capacitor), a fuse 34, a starter relay 36 and a neutral switch 38. The power system 28 enables the starter motor 26 to engage and drive the flywheel ring gear 24 based on an operator input (e.g., turning the ignition switch to START). The ESD 32 provides power to power the starter motor 26 and the neutral switch 38 ensures that the vehicle is in neutral before enabling power to the starter motor 26.

Figure 2:
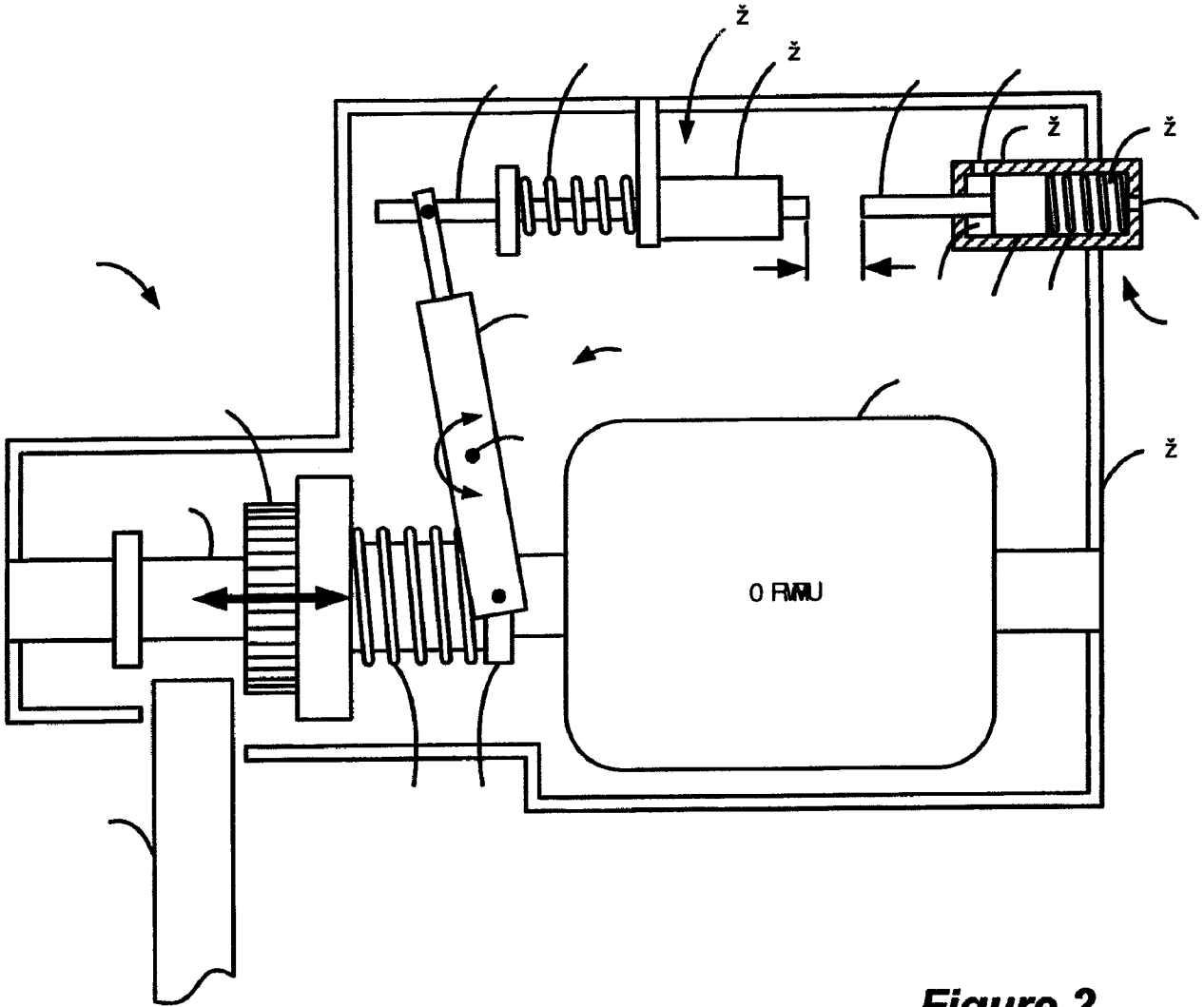
FIG. 2 is a functional block diagram of a starter motor of the engine starting system including a solenoid pinion armature (SPA) and an exemplary damper in a first position.

Referring now to FIG. 2, the starter motor 26 of the present invention will be described in further detail. The starter motor 26 includes a housing 40, a motor 42, a pinion shaft 44, a pinion gear 46, an actuator assembly 48, a solenoid pinion assembly (SPA) 50 and a damper 52. The pinion gear 46 is fixed for rotation with and is slidably disposed along the pinion shaft 44. More specifically, the actuator assembly 48 moves the pinion gear 46 between an engaged position, where it meshes with the flywheel ring gear 24, and a disengaged position, where it is out of mesh with the ring gear 24.

The actuator assembly 48 is driven by the SPA 50 and includes a spring 54, a collar 56 and an actuator arm 58. The actuator arm 58 is pivotable about an axis X and engages the SPA 50 at a first end and the collar 56 at a second end. The collar 56 is slidably disposed about the pinion shaft 44 and the spring 54 is positioned between the collar 56 and the pinion gear 46. The SPA 50 induces rotation of the actuator arm 58 about the axis X, which in turn induces linear movement of the collar 56 along the pinion shaft 44. Movement of the collar 56 towards the pinion gear 46 (i.e., away from the motor 42) induces corresponding linear movement of the pinion gear 46 through the spring 54. If the teeth of the pinion gear 46 are not immediately aligned with the teeth of the ring gear 34, the spring 54 is compressed to induce a biasing force against the pinion gear 46. Once the teeth are aligned, the biasing force pushes the pinion gear 46 into engagement with the ring gear 24.

The SPA 50 includes a solenoid 60, a spring 62 and an armature 64. The solenoid 60 induces linear movement of the armature 64 between a first position and a second position that respectively correspond with the engaged and disengaged positions of the pinion gear 46. The spring 62 biases the armature 64 into the first position. The solenoid 60 drives the armature 64 to the second position against the biasing force of the spring 62 based on the driver input. Once the solenoid 60 releases the armature 64 (e.g., after engine cranking is complete), the spring 62 biases the armature 64 back to the first position.

Figure 3:
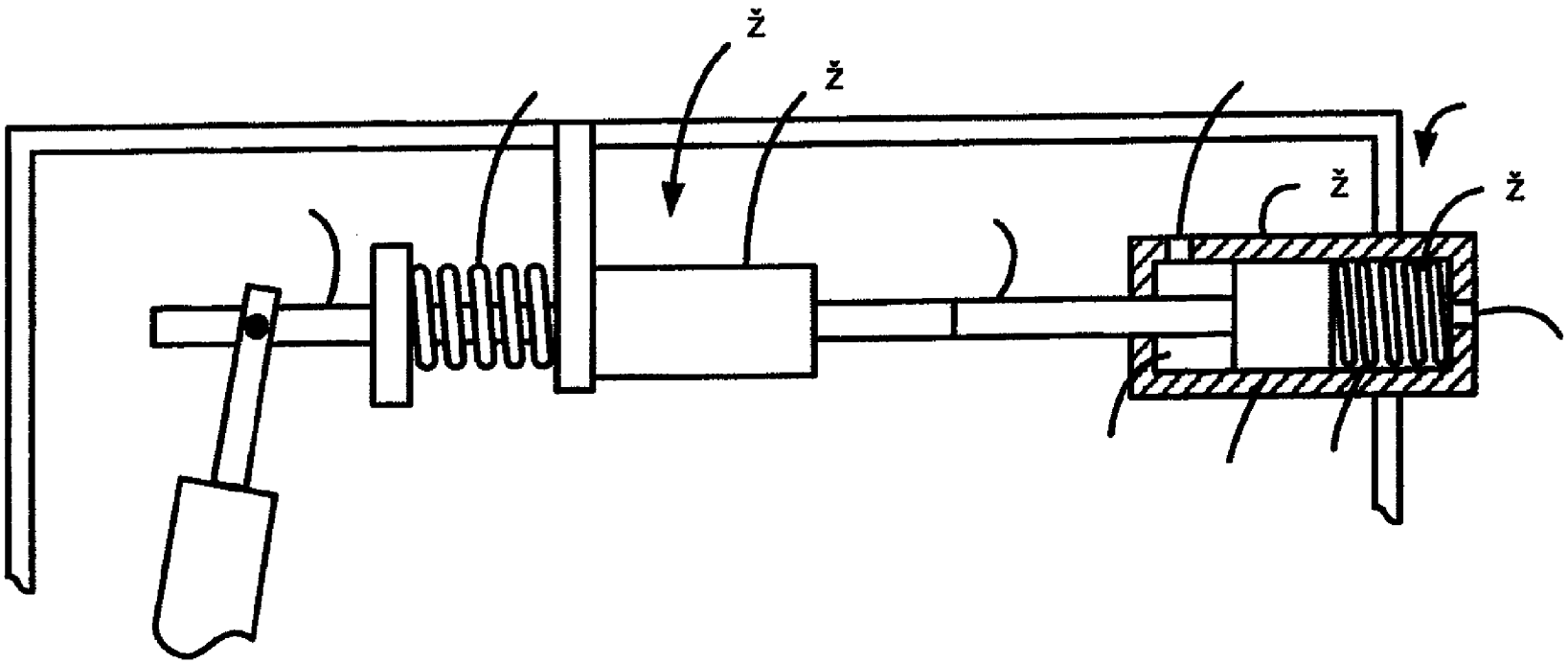
FIG. 3 is a functional block diagram of the SPA and the damper in a second position.

Referring now to FIGS. 2 and 3, the damper 52 will be discussed in further detail. The damper 52 dampens a velocity of the SPA 50 during movement of the SPA 50 to the second position. More specifically, as the armature 64 is induced to move to the second position, the velocity of the armature 64 steadily increases (i.e., the armature accelerates) for a first portion of travel. The armature 64 engages the damper 52 at a pre-determined point, which dampens the velocity to decrease the acceleration of the armature 64 during a second portion of travel.

As illustrated in FIGS. 2 and 3, the damper 52 includes a housing 70, a piston 72 slidably disposed within the housing 70, a piston rod 74 that extends from the piston 72 and a damper spring 76. The piston 72 divides an interior of the housing 70 into first and second chambers 78,80, respectively. Each of the first and second chambers 78,80 includes an opening 82,84, respectively, to enable fluid flow (e.g., air flow) to and from the first and second chambers 78,80. The spring 76 is disposed within the second chamber 80 and induces a biasing force against the piston 72 as it compresses the spring 76. An end of the piston rod 74 is offset a distance D from an end of the armature 64 (see FIG. 2). In this manner, un-dampened movement of the armature 62 is provided for the distance D. After the armature 64 engages the piston rod 74, the remainder of the armature movement is dampened via the spring 76.

Figure 4:
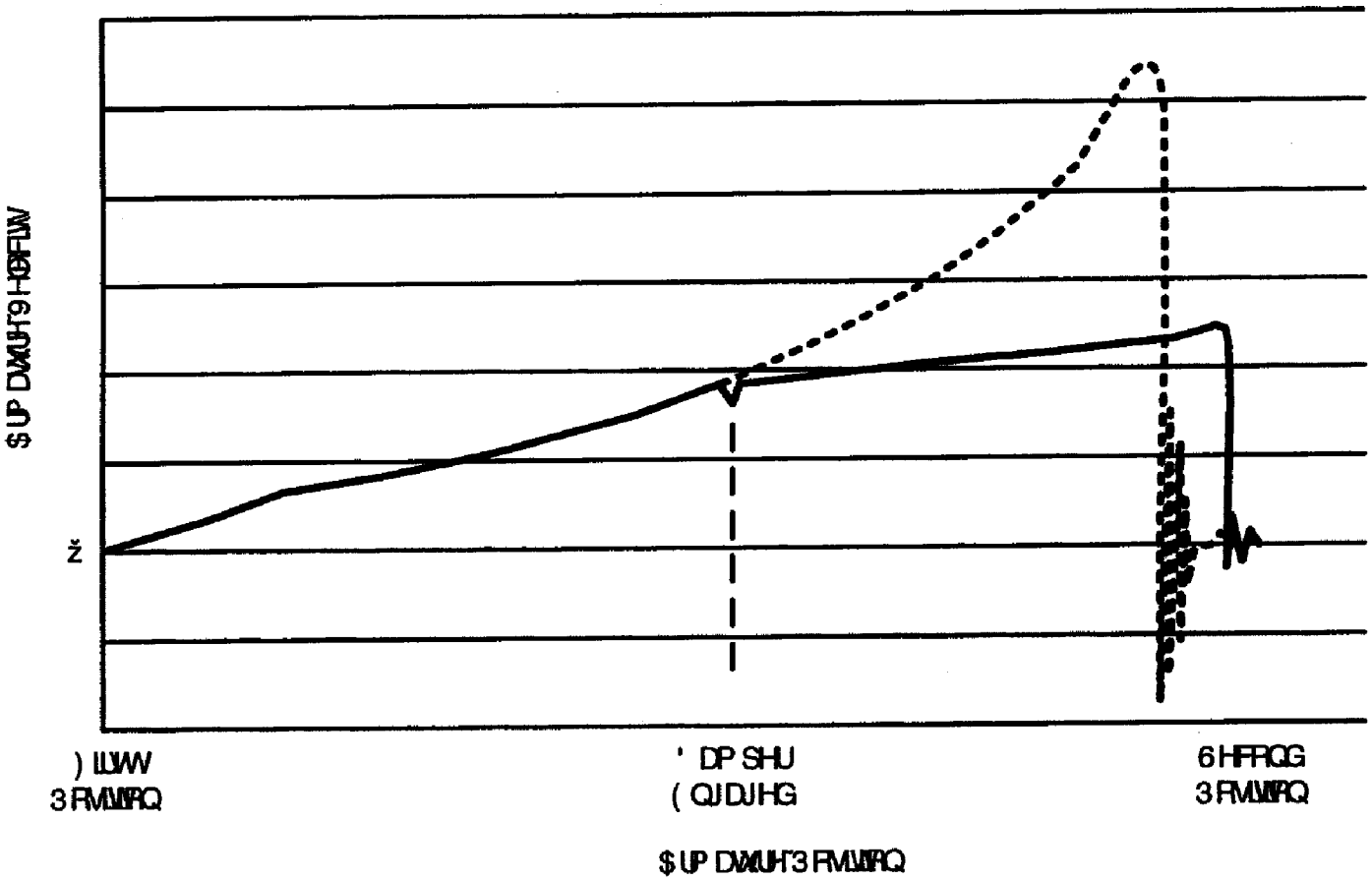
FIG. 4 is a graph illustrating exemplary un-damped and damped SPA velocities.

Referring now to FIG. 4, the graph illustrates un-damped (phantom) and damped (solid) SPA velocities. In the case of an un-damped SPA 50, the velocity steadily increases throughout movement of the armature 64. At the point where the armature 64 is near the second position, there is a large, rapid drop in the velocity and a subsequent oscillation until the velocity is zero. This large, rapid drop and subsequent oscillation generates noise in traditional, un-damped engine starting systems.

In the case of the damped SPA 50, the velocity of the armature 64 steadily increases until the armature engages the damper 52. After the armature 64 engages the damper 52, the velocity increase or acceleration is reduced. At the point where the armature 64 is near the second position, there is a drop in the velocity and a subsequent oscillation that are both significantly less in intensity than with the traditional, un-damped system. As a result, noise generation is inhibited.

Figure 5:
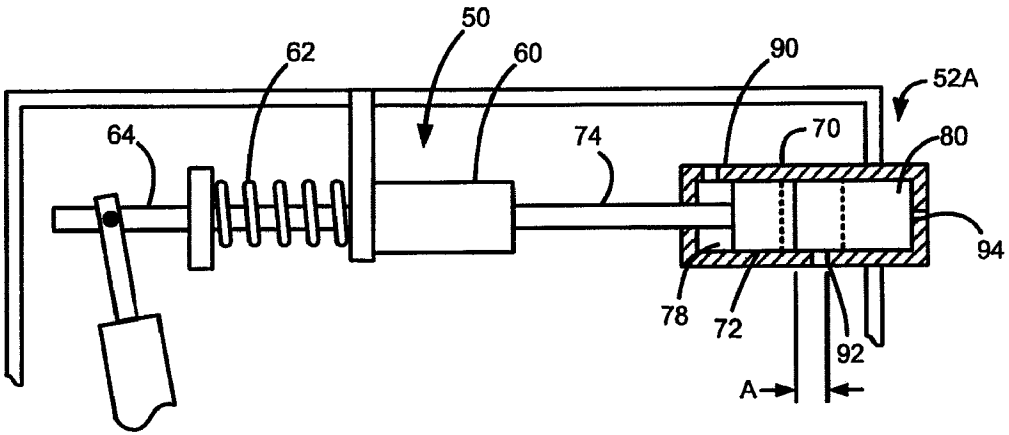
FIG. 5 is a functional block diagram of the SPA and a fluid damper that is directly coupled to the SPA.

Referring now to FIG. 5, an alternative damper 52A is illustrated. The damper 52A is a fluid-type damper (e.g., hydraulic or pneumatic) that includes a fluid disposed within the first and second chambers 78,80. The housing 70 includes a first fluid port 90, a second fluid port 92 and a restrictor port 94. The ports 90,92,94 are in fluid communication with a fluid circuit (not illustrated). The piston rod 74 is directly coupled to the armature 64. The restrictor port 94 enables intake and exhaust of the dampening fluid from the second chamber based on the direction of movement of the piston 72. More specifically, the restrictor port 94 has a set area that defines the rate of exhaust of the dampening fluid from the second chamber 80. In this manner, dampening is achieved by a back-pressure built up in the second chamber 80 as the dampening fluid is exhausted through the restrictor port 94.

The first fluid port 90 enables intake and exhaust of the dampening fluid from the first chamber 78 based on the direction of movement of the piston 72. The second fluid port 92 enables intake and exhaust of the dampening fluid from the second chamber 80. The location of the second fluid port 92 relative to a start position of the piston 72 defines the first period of un-damped travel of the armature 64. More specifically, during armature 64 travel over a distance A, the dampening fluid is exhausted through the second fluid port 92 and the restrictor port 94. As the piston 72 achieves the distance A, the piston 72 closes the second fluid port 92 inhibiting fluid flow therethrough. In this manner, the restrictor port 94 is the only exhaust path available and the resultant back-pressure induces dampening of the velocity of the SPA 50.

Figure 6:
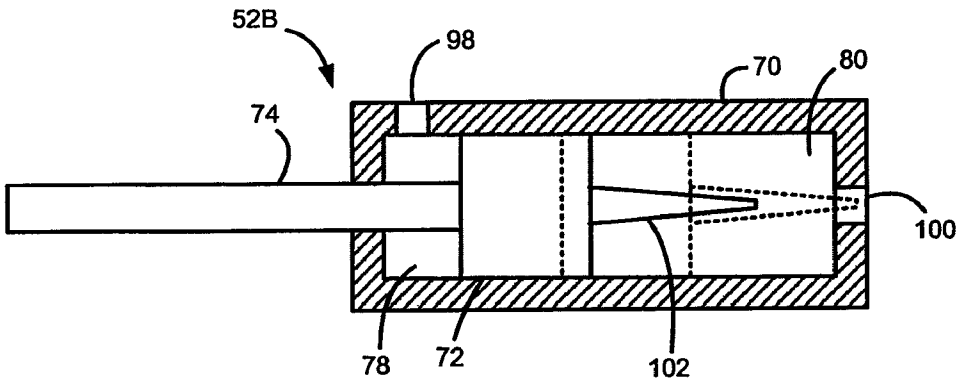
FIG. 6 is a functional block diagram of the SPA and a variable orifice fluid damper that is directly coupled to the SPA.

Referring now to FIG. 6, another alternative damper 52B is illustrated. The damper 52B includes a first port 98, a restrictor port 100 and a conical extension 102 extending from the piston 72. The conical extension 102 is aligned with the restrictor port 100, whereby it decreases an open area of the restrictor port 100 as the piston 72 moves toward the restrictor port 100. More specifically, the restrictor port 100 provides an exhaust path for the fluid within the second chamber 80 during travel of the piston 72 to the second position.

For a first portion of travel, the extension 102 is not received into the restrictor port 100 and fluid is exhausted through the restrictor port 100 to enable un-dampened movement of the armature 64. Once the conical extension 102 is received into the restrictor port 100, the available area for fluid exhaust through the restrictor port 100 decreases. As a result, back-pressure builds in the second chamber 80 and dampens movement of the armature 64. The further the conical extension 102 is received into the restrictor port 100, increasingly less area is available for fluid exhaust and the dampening force correspondingly increases.

Figure 7:
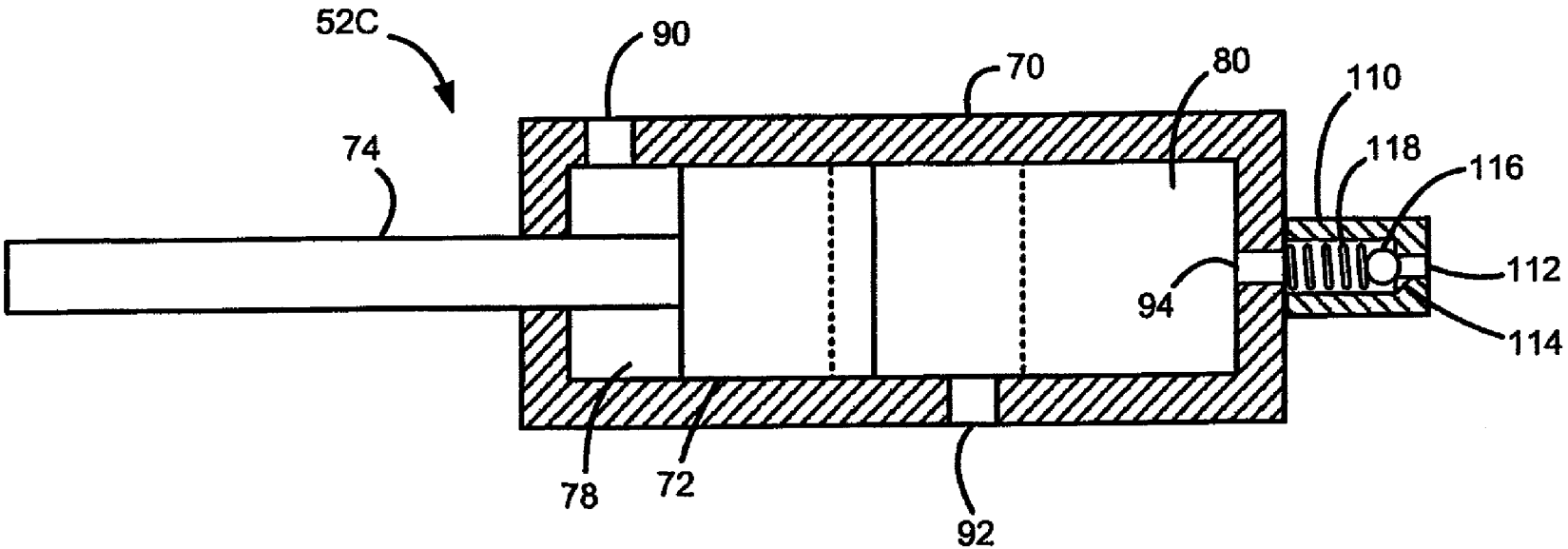
FIG. 7 is a functional block diagram of the SPA and a fluid damper including a one-way restrictor valve and that is directly coupled to the SPA.

Referring now to FIG. 7, yet another alternative damper 52C is illustrated. The damper 52C is similar to the damper 52A (see FIG. 5) but also includes a one-way restrictor valve 110 at the restrictor port 94. The restrictor valve 110 includes a large fluid port 112, a small fluid port 114, a ball 116 and a spring 118. The spring 118 biases the ball 116 against the large fluid port 112 to inhibit fluid flow therethrough. While the ball 116 is biased against the large fluid port 112, the small fluid port 114 remains open to provide a fluid exhaust path.

As the piston 72 travels towards the restrictor port, fluid is exhausted through both the second fluid port and the small fluid port 114 to enable un-dampened travel of the armature 64. Once the piston 72 achieves the second fluid port, the second fluid port is blocked by the piston 72 and the small fluid port 114 is the only available exhaust path. As a result, the back-pressure builds within the second chamber 80 and the armature 64 is dampened for the remainder of travel to the second position.

When the piston 72 moves back, fluid in the first chamber 78 is exhausted through the first fluid port. The ball 116 is moved against the bias force of the spring 118 to open the large fluid port 112, as a result of a low pressure in the second chamber 80. In this manner, fluid is drawn into the second chamber 80 through the large port 112 to enable the piston 72 to rapidly return to its starting position. Fluid is even more rapidly drawn into the second chamber 80 once the piston 72 moves past the second fluid port.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An engine starting system that regulates a position of a pinion gear of a starter motor between an engaged position and a disengaged position, comprising:

a solenoid pinion armature (SPA) that is coupled to said pinion gear and that is movable between a first position and a second position to move said pinion gear between said disengaged position and said engaged position; and a damper that mechanically dampens a velocity of said SPA during movement of said SPA to said second position to inhibit noise generation.

2. The engine starting system of claim 1 wherein movement of said SPA is un-damped for a first portion of travel to said second position and is damped for a second portion of travel to said second position.

3. The engine starting system of claim 1 wherein said damper includes a biasing member that imparts a biasing force on said SPA to dampen movement of said SPA to said second position.

4. The engine starting system of claim 1 wherein said damper includes a fluid that imparts a damping force on said SPA to dampen movement of said SPA to said second position.

5. The engine starting system of claim 4 wherein said damper includes a variable sized orifice that varies said damping force based on a position of said SPA.

6. The engine starting system of claim 4 wherein said damper includes a first orifice that enables exhaust of said fluid from said damper at a first rate and a second orifice that enables exhaust of said fluid at a second rate, wherein said first orifice is open for a first portion of travel of said SPA to said second position and is closed for a second portion of travel of said SPA to said second position.

7. The engine starting system of claim 4 wherein said damper includes a one-way restrictor valve that provides said damping force during movement of said SPA to said second position and that enables undamped movement of said SPA to said first position.

8. The engine starting system of claim 1 wherein said damper is offset a distance from said SPA to engage said SPA for a portion of travel from said first position to said second position.

9. The engine starting system of claim 1 wherein said damper is coupled to said SPA.

10. A method of regulating a position of a pinion gear of a starter motor between an engaged position and a disengaged position, comprising:

coupling a solenoid pinion armature (SPA) that is movable between a first position and a second position to said pinion gear to move said pinion gear between said disengaged position and said engaged position; and dampening a velocity of said SPA during movement of said SPA to said second position to inhibit noise generation via at least one of a biasing member, a fluid, an orifice, a piston, and a restrictor plate.

11. The method of claim 10 wherein said velocity of said SPA is un-damped for a first portion of travel to said second position and is damped for a second portion of travel to said second position.

12. The method of claim 10 wherein said dampening includes imparting a biasing force generated by a biasing member on said SPA to dampen said velocity.

13. The method of claim 10 wherein said dampening further includes imparting a damping force on said SPA using a fluid to dampen said velocity.

14. The method of claim 13 further comprising varying said damping force based on a position of said SPA.

15. The method of claim 13 wherein said dampening further includes:

exhausting said fluid from a damper at a first rate; and exhausting said fluid from said damper at a second rate, wherein said first rate is enabled for a first portion of travel of said SPA to said second position and is inhibited for a second portion of travel of said SPA to said second position.

16. The method of claim 13 wherein said dampening includes providing a one-way restrictor valve that enables said damping force during movement of said SPA to said second position and that enables undamped movement of said SPA to said first position.

17. The method of claim 10 wherein further comprising offsetting a damper a distance from said SPA to engage said SPA for a portion of travel from said first position to said second position.

18. The method of claim 10 further comprising coupling a damper to said SPA.

19. An engine starting system including a starter motor that selectively drives a crankshaft, comprising:

a pinion gear that is movable between an engaged position and a disengaged position;

a solenoid pinion armature (SPA) that is coupled to said pinion gear and that is movable between a first position and a second position to move said pinion gear between said disengaged position and said engaged position; and a damper that dampens a velocity of said SPA during a portion of movement of said SPA to said second position to inhibit noise generation, wherein said damper includes an element that is not in contact with said SPA when said SPA is in said first position and is in contact with said SPA before said SPA is in said second position.

20. The engine starting system of claim 19 wherein said damper includes a biasing member that imparts a biasing force on said SPA to dampen movement of said SPA to said second position.

21. The engine starting system of claim 19 wherein said damper includes a fluid that imparts a damping force on said SPA to dampen movement of said SPA to said second position.

22. The engine starting system of claim 21 wherein said damper includes a variable sized orifice that varies said damping force based on a position of said SPA.

23. The engine starting system of claim 21 wherein said damper includes a first orifice that enables exhaust of said fluid from said damper at a first rate and a second orifice that enables exhaust of said fluid at a second rate, wherein said first orifice is open for a first portion of travel of said SPA to said second position and is closed for a second portion of travel of said SPA to said second position.

24. The engine starting system of claim 21 wherein said damper includes a one-way restrictor valve that provides said damping force during movement of said SPA to said second position and that enables undamped movement of said SPA to said first position.

25. The engine starting system of claim 19 wherein said damper is offset a distance from said SPA to engage said SPA for a portion of travel from said first position to said second position.

26. The engine starting system of claim 19 wherein said damper is coupled to said SPA.

27. The engine starting system of claim 19 wherein said element includes a rod.

* * * * *